US005156369A

United States Patent [19]

Tizzoni

[11] Patent Number: 5,156,369

[45] Date of Patent: Oct. 20, 1992

[54] BEACH UMBRELLA

[76] Inventor: Salvatore Tizzoni, 8465 Fernand Forest, Montreal, Quebec, Canada, H1E 4K2

[21] Appl. No.: 710,542

[22] Filed: Jun. 5, 1991

[51] Int. Cl.[5] ..... F16M 13/00

[52] U.S. Cl. ..... 248/545; 135/98; 248/156; 248/530

[58] Field of Search ..... 248/156, 530, 532, 533, 248/545, 96, 522; 52/157, 155, 156; 135/98, 99, 114, 118

[56] References Cited

U.S. PATENT DOCUMENTS

| | | | |
|---|---|---|---|
| 669,340 | 3/1901 | Fyfe | 52/157 |
| 2,759,486 | 8/1956 | Pesaturo | 135/16 |
| 3,011,597 | 12/1961 | Galloway et al. | 52/156 X |
| 3,293,809 | 12/1966 | Daline | 52/157 |
| 4,162,789 | 7/1979 | Hollaway | 52/157 X |
| 4,832,304 | 5/1989 | Morgulis | 248/533 |

FOREIGN PATENT DOCUMENTS

| | | | |
|---|---|---|---|
| 0312675 | 3/1989 | European Pat. Off. | 135/16 |
| 300624 | 9/1919 | Fed. Rep. of Germany | 248/156 |
| 1272460 | 5/1972 | United Kingdom | 135/16 |

*Primary Examiner*—Carl D. Friedman
*Assistant Examiner*—Derek J. Berger
*Attorney, Agent, or Firm*—Samuel Meerkreebs

[57] ABSTRACT

A ground anchoring arrangement for attachment to, for example, the pole of a beach umbrella or the like consists of a hollow cylindrical member having a rod rotatably supported therein. A spiral screw is attached to one end of the rod, and the other end of the rod is grippingly (CANC) attachable to a handle rotator. Thus, when the handle rotator is rotated, the rod rotates, and the spiral screw rotates with it. The point of the screw is placed adjacent to the ground and rotated so that the screw digs itself into the earth to firmly fix the elongated cylinder in the ground.

8 Claims, 1 Drawing Sheet

BEACH UMBRELLA

BACKGROUND OF INVENTION

1. Field of the Invention

The invention relates to an elongated ground anchoring arrangement for attachment to a device supporting pole. More specifically, the invention relates to such an elongated ground anchoring arrangement which comprises a hollow member having a screw means at one end thereof, and means for rotating said screw means relative to said cylindrical member.

2. Description of Prior Art

Ground anchoring arrangements may be used for anchoring pole mounted devices such as, for example, flags, beach umbrellas, and the like, in the ground. Arrangements for this purpose are known in the art and especially arrangements for anchoring beach umbrellas as illustrated in, for example, European Patent 312,675, Carbone, Apr. 26, 1989, British Patent 1,272,460, Asplin, Apr. 26, 1972, U.S. Pat. No. 4,832,304, Morgulis, May 23, 1989 and U.S. Pat. No. 2,759,486, Pesaturo, Aug. 21, 1956.

The '675 patent teaches a ground anchoring arrangement which is in the shape of a stick having a screw means at one end. The screw means is formed integrally with the stick so that, when the stick is rotated, the screw means rotates with the stick. The '460 patent teaches a ground anchoring arrangement which includes a stem, in the form of a hollow cylindrical member, with a screw means fixedly attached to the bottom end of the hollow cyindrical member. Thus, once again, the screw means rotates with the hollow cylindrical member.

The arrangement in the '304 patent is similar to the arrangement of the '675 patent in that it consists of a post 12 having a screw means 16 formed at one end thereof. In the '304 patent, as in the '675 patent, the screw means is formed integrally with the post. The '486 patent teaches an arrangement consisting of a pick 13 having a pointed free end. As the pointed end does not have any screw threads, the arrangement in the '486 patent does not include any screw means.

SUMMARY OF THE INVENTION

It is therefore an object of the invention to provide a novel elongated ground anchoring arrangement for attachment to a device supporting pole.

It is a more specific object of the invention to provide such an arrangement which comprises an elongated hollow member, a screw means at one end of the member, and means for rotating said screw means relative to said hollow member.

The arrangement is detachably attachable to the device supporting pole at the other end thereof.

In accordance with the invention there is provided an elongated ground anchoring arrangement for attachment to a device supporting pole, said device supporting pole having a first end, at which said device is supported, and a second end;

said ground anchoring arrangement comprising:

an elongated hollow member having a first end and a second end;

means for detachably attaching said second end of said device supporting pole to said first end of said elongated hollow member;

an elongated rod extending through said hollow member and being rotatably supported therein, said elongated rod having a first end adjacent the first end of said elongated hollow member and a second end adjacent the second end of the said elongated hollow member;

handle rotating means;

said handle rotating means being attachable to said rod at said first end thereof;

screw means mounted at said second end of said rod, externally of said elongated hollow member, for rotation with said rod;

wherein, when said handle rotating means is rotated, said rod rotates with said handle rotating means and said screw means rotates with said rod, and, thereby, with said handle rotating means.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
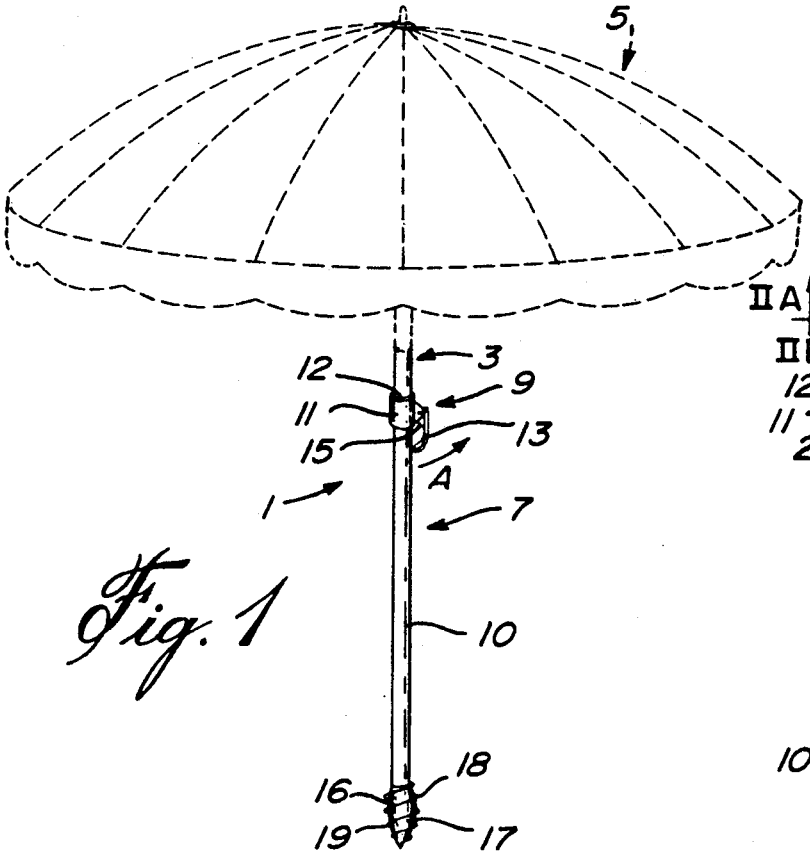
FIG. 1 is a perspective view of the ground anchoring arrangement attached to a beach umbrella.

Referring to FIG. 1, the elongated ground anchoring arrangement, illustrated generally at 1, is shown detachably attached to a device supporting pole 3 which supports a device 5. In the illustrated embodiment, the device 5 comprises a canopy so that the canopy 5 and the pole 3 together form an umbrella, for example, a beach umbrella. If the device 5 were the cloth of a flag, then the cloth and the poles would together form a flag.

The ground anchoring arrangement includes a ground anchor supporting portion 7 and a means 9 for detachably attaching the device supporting pole 3 to the ground anchor supporting portion 7. The means 9 consists of a collar 11 having an open end 12, a handle 13 and a slat-like member 15. The means 9 is disposed at one end of the ground anchoring arrangement. Disposed at the other end thereof is a screw means 17 having a spiral screw thread 19.

Figure 2B:
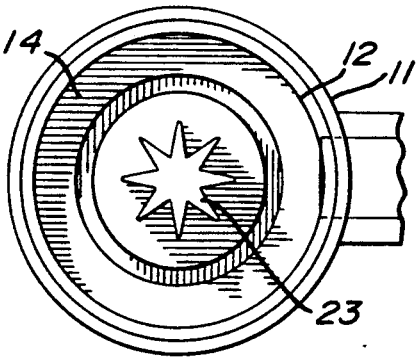
FIG. 2B is a cross-section through IIB—IIB of FIG. 2.
Figure 2A:
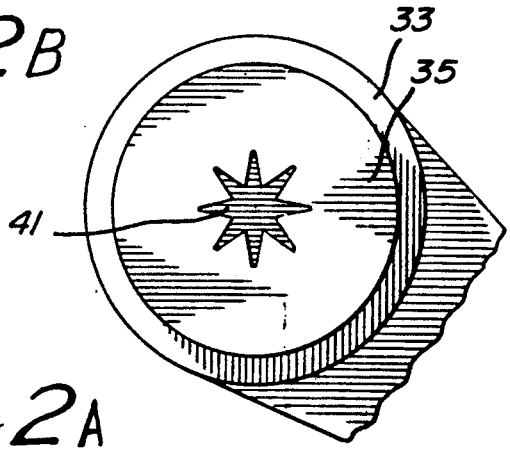
FIG. 2A is a cross-section through IIA—IIA of FIG. 2 illustrating the shaped indentation in the plug of the rotating handle.
Figure 2:
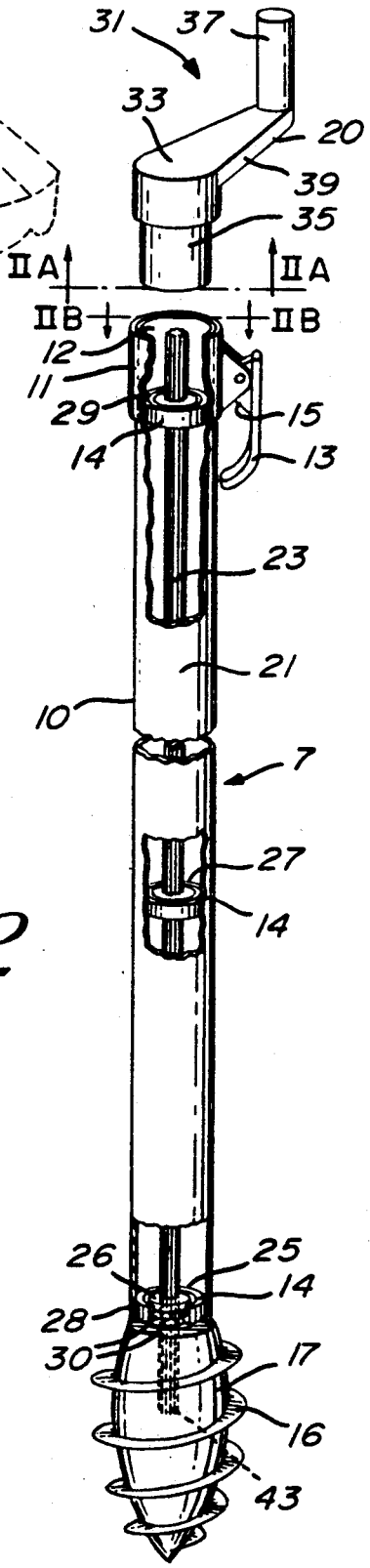
FIG. 2 is a partially cut-away perspective view of the hollow cylindrical member illustrating how the rotating handle is connected thereto to cause rotation of the screw means and also illustrating the rod and bearings in the cylindrical member.

Turning now to FIG. 2, the ground anchor supporting portion 7 comprises a hollow member 21, in the illustrated embodiment, a hollow cylindrical member, through which extends a rod 23. As can be seen, the diameter of the screw means 17 is greater than the diameter of the hollow cylindrical member 21.

As also seen in FIG. 2, the rod 23 is rotatingly supported in the hollow cylindrical member 21 by bearing members 25, 27 and 29. As seen at bearing member 25, each bearing includes an inner race 26 and an external race 28. Disposed between the inner race 26 and the outer race 28 are ball bearings 30. As is well known in the art, the casing is completely filled with at least one row of bearings, and the wall 26 is movable relative to the casing 28.

As seen in FIG. 2B, the cross-sectional shape of the rod is non-circular, in the illustrated embodiment, a star-like shape. However, the cross-sectional shape of the rod can be square, rectangular, triangular, pentagonal, oval, etc. It is only necessary, as will be seen below, that the cross-sectional shape of the rod be non-circular.

The inner race 26 of the bearing members 25, 27 and 29 will be fixed to the rod so that the inner races 26 of the bearing members 25, 27 and 29 will grip the rod and rotate therewith. The rotation of the inner races 26 and, thereby, the rod 23, are aided by the ball bearings 30 in the bearing members.

The walls of the outer race 28 which abut the inner surface of the hollow cylindrical member 21 may be fixedly attached thereto. Also, the bearing members 25, 27 and 29 are fixedly attached, at spaced intervals, to the rod 23.

It is also seen that the rotating handle 31 includes an attachment member 33, having an underlying plug 35, and a hand grasping member 37. A bridge 39 joins the attachment member 33 to the hand grasping member 37. As seen in FIG. 2A, the bottom of the plug includes a shaped indentation 41. The shape of the shaped indentation is identical to the cross-sectional shape of the rod 23 so that, when the end of the rod 23 is inserted into the shaped indentation, the rod will be gripped by the rotating handle.

The screw means 17 is attached, either fixedly, or detachedly, to the other end of the rod 23. In one way of attaching the screw means 17 to the rod, an opening 43, having a cross-sectional shape which is identical in size and shape to the cross-sectional shape of the rod is provided at the top of the screw means, and the other end of the rod 23 is force-fit into the opening 43. Alternatively, the screw means 17 could be attached by screws or pins to the rod 23, or it could be formed integrally with 23.

In operation, to insert the pole 3 into the collar 11, the handle 13 is moved outwardly and upwardly in the direction of arrow A as shown in FIG. 1. The pole 3 is then slid in to the open end of the collar 11.

To attach the pole 3 to the ground anchor supporting portion 7, the inner end of the slat-like member 15 could be flat and abut against the outer surface of the pole 3 whereby to attach the pole by frictional engagement. Alternatively, the slat-like member 15 can include a portion which extends beyond the outer diameter of 3 which would include a slot for receiving the extending portion of the slat-like member 15. Alternative arrangements, as is well known in the art, could be used for detachably attaching the device supporting pole 3 to the ground anchor supporting portion 7.

In either case, after the free end of the pole 3 is slid into the open end of the collar 11, the handle 13 is returned to the position as illustrated in FIG. 1 so that it will detachably attach the pole 3 to the ground anchor supporting portion 7.

To remove the pole 3, the handle 13 is once again moved outwardly and upwardly in the direction of can be slid out of the handle 11.

To anchor the ground anchoring arrangement in the ground, the pole 3 is removed as above and the plug 35 of rotating handle 31 is slid into the open end of the collar 11 until the plug 35 grips the end of rod 23. Accordingly, the rod will now rotate with the rotating handle.

The screw means is then placed with its point on the surface of the ground into which the arrangement is to be anchored, and the rotating handle is rotated. This will cause the rod 23 and, thereby, the screw means 17 to rotate so that the screw means 17 will dig itself into the ground. The handle will be rotated until such time as the ground anchoring arrangement is firmly anchored in the ground. The rotating handle is then removed, and the device supporting pole can be inserted into the collar to be detachably attached to the ground anchoring arrangement so that the device will be firmly anchored in the ground.

To remove the ground anchoring arrangement from the ground, the pole 3 is removed from the collar 11 as above-described and the rotating handle 31 is once again attached to the ground anchoring arrangement. The handle is now rotated in the opposite direction so that the screw means 17 will dig itself out of the ground.

Although the rod 23 has been above-described as having a uniform cross-section, it is of course obvious that the rod 23 could have a circular cross-section for most of its length but having either one or two shaped ends.

Although a particular embodiment has been illustrated, this was for the purpose of describing, but not limiting, the invention. Various modifications, which will come readily to the mind of one skilled in the art, are within the scope of the invention as defined in the appended claims.

I claim:

1. A device supporting structure comprising an elongated ground anchoring arrangement attached to a device supporting pole, said device supporting pole having a first end, at which said device is supported, and a second end;

said ground anchoring arrangement comprising:

an elongated hollow member having a first and a second end;

means for detachably attaching said second end of said device supporting pole to said first end of said elongated hollow member;

an elongated rod extending through said hollow member and being rotatably supported therein, said elongated rod having a first end adjacent the first end of said elongated hollow member and a second end adjacent the second end of the said elongated hollow member;

the first end of said elongated rod having a non-circular cross-sectional shape;

handle rotating means;

said handle rotating means being attachable to said elongated rod at said first end thereof;

screw means mounted at said second end of said elongated rod, externally of said elongated hollow member, for rotation with said rod;

wherein, when said handle rotating means is rotated, said rod rotates with said handle rotating means and said screw means rotates with said rod, and, thereby, with said handle rotating means.

2. An arrangement as defined in claim 1 wherein said elongated rod is rotatably supported in said elongated hollow member by spaced bearing means disposed in said elongated hollow member.

3. An arrangement as defined in claim 2 wherein said means for detachably attaching comprises a collar at said first end of said elongated hollow member, the collar having an open end having a shape corresponding to the cross-sectional shape of the device supporting pole;

whereby, said collar receives said second end of said device supporting pole through the open end of said collar.

4. An arrangement as defined in claim 3 wherein said collar mounts a lock means for detachably attaching said second end of said device supporting pole to said first end of said elongated hollow member.

5. An arrangement as defined in claim 4 wherein said screw means comprises a spiral screw.

6. An arrangement as defined in claim 1 wherein said handle rotating means comprises a plug means having a cross-sectional shape corresponding to the shape of the open end of the collar whereby said collar receives said plug through the open end thereof;

said plug having an indentation whose shape corresponds with the non-circular cross-sectional shape of said first end of said elongated rod;

whereby, said elongated rod is grippingly attached to said plug at said first end of said elongated rod so that said elongated rod rotates with the rotation of said handle rotating means.

7. An arrangement as defined in claim 6 wherein said elongated hollow member comprises an elongated circular cylindrical member.

8. An arrangement as defined in claim 1 wherein said device comprises a canopy for a beach umbrella or the like whereby said device and said device supporting pole comprise a beach umbrella or the like.

* * * * *